US007704288B2

(12) United States Patent
Rivas et al.

(10) Patent No.: US 7,704,288 B2
(45) **Date of Patent: *Apr. 27, 2010**

(54) WATER IN HYDROCARBON EMULSION USEFUL AS LOW EMISSION FUEL AND METHOD FOR FORMING SAME

(75) Inventors: Hercilio Rivas, Caracas (VE); Xiomara Gutierrez, Caracas (VE); Manuel A. Gonzalez, Caracas (VE); Geoffrey McGrath, Caracas (VE); Migdalia Carrasquero, Miranda (VE); Francisco Lopez-Linares, San Antonio de Los Altos (VE); Roberto Galiasso, San Antonio de Los Altos (VE)

(73) Assignee: Intevep, S.A., Caracas (VE)

( * ) Notice: Subject to any disclaimer, the term of this patent is extended or adjusted under 35 U.S.C. 154(b) by 239 days.

This patent is subject to a terminal disclaimer.

(21) Appl. No.: 11/846,283

(22) Filed: Aug. 28, 2007

(65) Prior Publication Data

US 2008/0060258 A1 Mar. 13, 2008

Related U.S. Application Data

(63) Continuation of application No. 09/565,556, filed on May 5, 2000, now Pat. No. 7,276,093.

(51) Int. Cl.
*C10L 1/32* (2006.01)

(52) U.S. Cl. ..... 44/301; 44/302

(58) Field of Classification Search ..... 44/301, 44/302

See application file for complete search history.

(56) References Cited

U.S. PATENT DOCUMENTS

| | | | | |
|---|---|---|---|---|
| 4,565,548 | A | | 1/1986 | Davis et al. |
| 4,568,354 | A | | 2/1986 | Davis et al. |
| 4,568,355 | A | | 2/1986 | Davis et al. |
| 4,568,356 | A | | 2/1986 | Chambers |
| 4,599,088 | A | | 7/1986 | Davis et al. |
| 4,696,638 | A | * | 9/1987 | DenHerder ..... 431/4 |
| 4,744,796 | A | | 5/1988 | Hazbun et al. |
| 4,770,670 | A | | 9/1988 | Hazbun et al. |
| 4,908,154 | A | * | 3/1990 | Cook et al. ..... 516/21 |
| 5,004,479 | A | * | 4/1991 | Schon et al. ..... 44/302 |
| 5,104,418 | A | | 4/1992 | Genova et al. |
| RE35,237 | E | | 5/1996 | Gunnerman |
| 5,743,922 | A | | 4/1998 | Peter-Hoblyn et al. |
| 5,873,916 | A | | 2/1999 | Cemenska et al. |

FOREIGN PATENT DOCUMENTS

EP 0157684 A 10/1985

(Continued)

OTHER PUBLICATIONS

McCutheon's Emulsifiers and Detergents, 1983, MC Publishing Co, NJ, North American Edition, pp. 272-299.*

McCutcheon's Emulsifiers & Detergents, 1983 North American Edition, McCutcheon Division, MC Publishing Co., Glen Rock, NJ, US, pp. 272-299.

Synthesis and centane improver performance of fatty acid glycol nitrates, G.J. Suppes et al., Univeristy of Kansas, Department of Chemical and Petroleum Engineering, Lawrence, Kansas, US, Received Dec. 5, 1997; received in revised form Jun. 24, 1998.

(Continued)

*Primary Examiner*—Cephia D Toomer
(74) *Attorney, Agent, or Firm*—Bachman & LaPointe, P.C.

(57) ABSTRACT

A water-in-hydrocarbon emulsion includes a water phase, a hydrocarbon phase and a surfactant, wherein the water phase is present in an amount greater than or equal to about 5% vol. with respect to volume of the emulsion, and the water phase and the surfactant are present at a ratio by volume of the water phase to the surfactant of at least about 1. A method for preparing the emulsion is also provided.

12 Claims, 4 Drawing Sheets

FOREIGN PATENT DOCUMENTS

| | | | |
|---|---|---|---|
| EP | 0157684 | A1 | 10/1985 |
| EP | 0475620 | A2 | 3/1992 |
| EP | 1252270 | A | 10/2002 |
| GB | 2217229 | A | 10/1989 |
| WO | 97/34969 | | 9/1997 |
| WO | 9734969 | A1 | 9/1997 |
| WO | 9913031 | A1 | 3/1999 |
| WO | 99/35215 | A2 | 7/1999 |
| WO | 0148123 | A1 | 7/2001 |

OTHER PUBLICATIONS

Suppes G J et al: "Synthesis and cetane improver performance of fatty acid glycol nitrates" Fuel, IPC Science and Technology Press, Guildford, GB, vol. 78, No. 1, January 1999, pp. 73-81, XP004285945 ISSN: 0016-2361.

* cited by examiner

WATER IN HYDROCARBON EMULSION USEFUL AS LOW EMISSION FUEL AND METHOD FOR FORMING SAME

CROSS REFERENCE TO RELATED APPLICATION

This is a continuation of U.S. application Ser. No. 09/565,556, filed May 5, 2000 now U.S. Pat. No. 7,276,093.

BACKGROUND OF THE INVENTION

The invention relates to a water-in-hydrocarbon emulsion which is useful as a low emission fuel for compression ignition engines and to a method for forming same.

The impact of incorporating water into the combustion systems of Diesel engines has been presented in technical literature with an important incidence in reduction in exhaust emission rates of nitrogen oxides and particulates and with moderate reductions, and in certain cases with increases, in the exhaust emission rates of hydrocarbons and carbon monoxide. According to various investigations, the effect of reducing peak flame temperatures in the combustion chamber is the dominant cause for lower nitrogen oxide emissions.

The Clean Air Act mandates progressive decreases in smoke, particulate and nitrogen oxide emissions from both stationary and mobile sources. Attempts to address these requirements using water-in-hydrocarbon emulsions have met with very serious technical and economic problems due to the short-term stability of emulsions formed having droplet sizes in the macroemulsion range, and further due to the large quantities of surfactants and cosolvents required to form emulsions having droplet sizes in the microemulsion range.

For example, U.S. Pat. Nos. 4,568,354 and 4,568,355 to Davis et al. are drawn to processes for converting a hazy or potentially hazy water saturated alcohol-gasoline mixture into a clear stable gasoline composition having an improved octane rating. The system so produced has a water content of no more than 1% by volume, and relatively large volumes of non-ionic surfactant are used to produce this system.

Similarly, U.S. Pat. Nos. 4,770,670 and 4,744,796 to Hazbun et al. also disclose the formation of stable microemulsions which contain large amounts of surfactant as compared to the water content.

Other efforts in this area include U.S. Pat. No. 5,104,418, WO 99/35215, U.S. Pat. No. Re. 35,237, U.S. Pat. No. 5,743,922, WO 97/34969, U.S. Pat. No. 5,873,916 and WO 99/13031.

In spite of the disclosures in the a foregoing patents, the need remains in the industry for a water-in-hydrocarbon emulsion which is suitable as a combustible fuel and which contains a desirable amount of water without the need for relatively large amounts of surfactant and/or other stabilizing agents.

It is therefore the primary object of the present invention to provide water-in-hydrocarbon emulsions which are useful as combustible fuels and which are both stable and formed using relatively small amounts of surfactant.

It is a further object or the present invention to provide a method for forming such water-in-hydrocarbon emulsions utilizing a synergetic combination of mixing energy and surfactant package blend.

It is a still further object of the present invention to provide emulsions and methods for forming such emulsions wherein additional combustion properties are incorporated into the fuel through the surfactant package.

Other objects and advantages of the present invention will be readily apparent from a consideration of the following.

SUMMARY OF THE INVENTION

In accordance with the present invention, the foregoing objects and advantages have been readily attained.

In accordance with the invention, a water-in-hydrocarbon emulsion is provided, which emulsion comprises a water phase, a hydrocarbon phase and a surfactant, wherein said water phase is present in an amount greater than or equal to about 5% vol. with respect to volume of said emulsion, and said water phase and said surfactant are present at a ratio by volume of said water phase to said surfactant of at least about 1.

Stable macroemulsions and microemulsions are provided, each having advantageous features and characteristics.

In further accordance with the invention, a method is provided for forming a water-in-hydrocarbon emulsion which method comprises the steps of providing a water phase; providing a hydrocarbon phase; providing a surfactant; mixing said water phase, said hydrocarbon phase and said surfactant in amounts sufficient to provide a water content of at least about 5% vol. with respect to said emulsion, and a ratio by volume of said water phase to said surfactant of at least about 1, wherein said mixing is carried out at a mixing intensity sufficient to form a stable emulsion of said water phase in said hydrocarbon phase.

BRIEF DESCRIPTION OF THE DRAWINGS

A detailed description of preferred embodiments of the present invention follows, with reference to the attached drawings, wherein.

DETAILED DESCRIPTION

Figure 1:
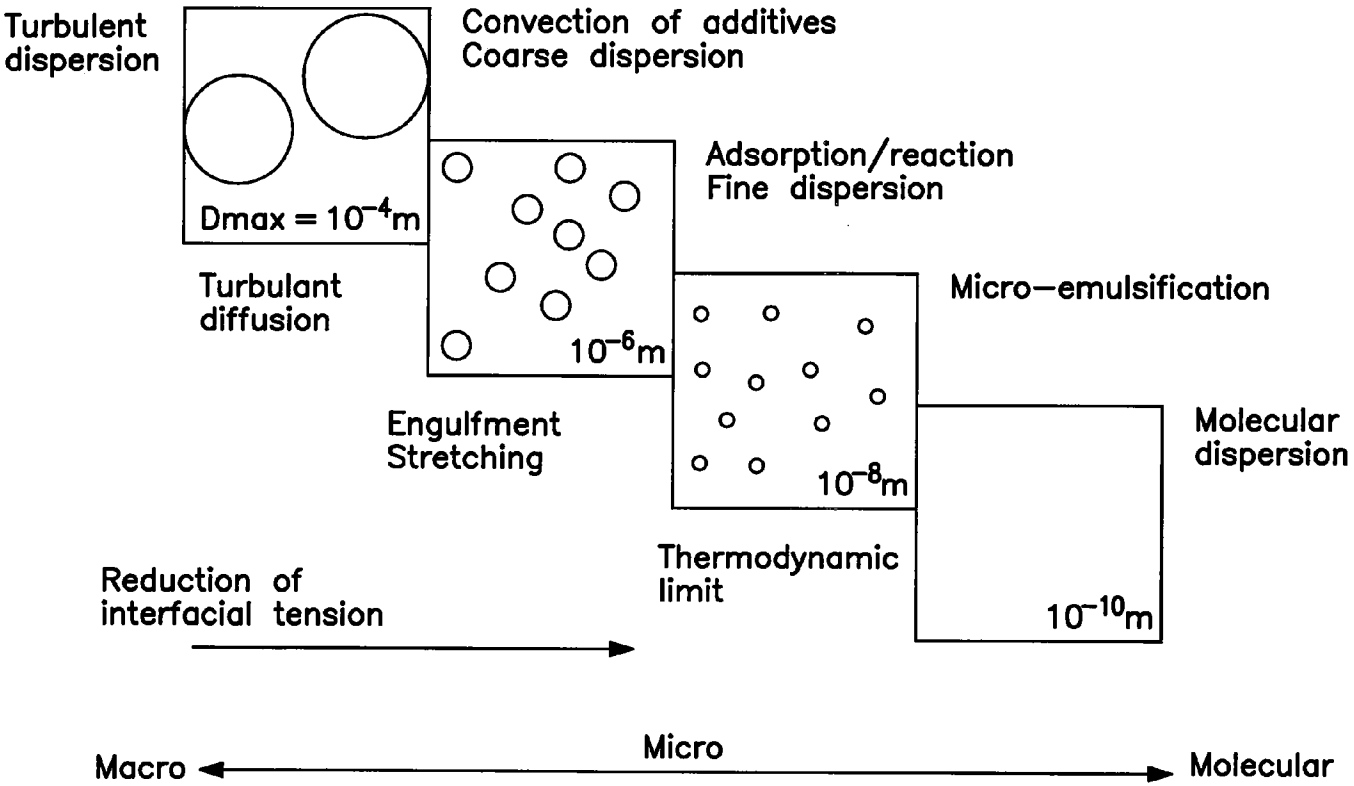
FIG. 1 is a schematic representation illustrating the mechanism of the mixing process of the present invention.

The invention relates to water-in-hydrocarbon emulsions and a method for forming same whereby the emulsion is stable and can advantageously be used as a combustible fuel, for example for compression ignition engines and the like. The emulsion has beneficial characteristics as a fuel including reduced emissions. The emulsions in accordance with the present invention include stable macroemulsions and microemulsions, each of which include a dispersed water phase and a continuous hydrocarbon phase as well as an advantageous surfactant package which, as will be discussed below, is preferably selected in combination with particular emulsion formation mixing intensities, so as to provide the desired stable emulsion.

Suitable hydrocarbons for use in making the emulsions of the present invention include petroleum hydrocarbons and natural gas derived products, examples of which include Diesel fuel and other low gravity hydrocarbons such as Fischer-Tropsch synthetic Diesel and paraffins $C_{10}$ to $C_{20}$.

Emulsions including this hydrocarbon in accordance with the present invention have reduced $NO_x$ emissions and C emissions, and improved opacity as compared to the hydrocarbon alone.

Further, improvement in air-fuel mixing conditions and of evaporative spray in the combustion chamber of Diesel engines can be accomplished utilizing the emulsion as compared to the base fuel, which can result in improvements in the fuel fraction efficiency and a better energy balance utilization in combination with the lower exhaust gas and particulate emissions. One example of a suitable hydrocarbon is a Diesel fuel characterized as follows:

TABLE 1

| | | |
|---|---|---|
| Sulfur content | (% wt/wt) | <0.5 |
| Density @ 15° C. | (kg/m$^3$) | <860 |
| Viscosity @ 40° C. | (mm$^2$/s) | <4.5 |
| T95 | (° C.) | <370 |
| Flash point | (° C.) | >52 |

The water phase for use in forming emulsions in accordance with the present invention can suitably be from any acceptable water source, and is preferably a water which is available in sufficient quantities, preferably in close proximity to the location where emulsions are to be formed, and preferably at an inexpensive cost. For example, a suitable water phase could be water such as 310 ppm brine. Of course, any other water from a suitable source and having various acceptable characteristics for use as a component of a combustible fuel would be acceptable.

The surfactant package forms an important portion of the present invention, particularly when combined with particular emulsion forming steps as will be further described below. The surfactant or surfactant package of the present invention is preferably a package including both a lipophilic surfactant component and a hydrophilic surfactant component. This combination of components advantageously serves to increase the amount of molecules which are present at the water-hydrocarbon interface, and to minimize the interfacial tension therein, thereby allowing substantially reduced amounts of surfactants to be utilized while nevertheless providing a stable emulsion. This is particularly advantageous from a cost standpoint as compared to conventional known emulsions and processes.

Suitable surfactants, as set forth above, include both lipophilic surfactant components and hydrophilic surfactant components. Suitable lipophilic surfactant components include neat oleic acid, sorbitan ester monooleate, sorbitan ester trioleate, ethoxylated oleic acid and mixtures thereof. These lipophilic surfactant components typically have a hydrophile-lipophile balance, or HLB, of between about 1 and about 8. The hydrophile-lipophile balance or HLB of a surfactant is the relative simultaneous attraction that the surfactant demonstrates for water and oil. Substances having a high HLB, above about 12, are highly hydrophilic while substances having a low HLB, below about 8, are highly lipophilic. Surfactants having an HLB between about 8 and about 12 are considered intermediate.

Suitable hydrophilic surfactant components include oleic acid which has been neutralized, preferably 100% neutralized, with monoethanolamine, polyethoxylated fatty amine and mixtures thereof. These hydrophilic surfactant components typically have an HLB of between about 10 and about 18.

Neutralized oleic acid may be formed as hydrophilic surfactant component by mixing, either separately or during emulsion formation, neat oleic acid and monoethanolamine (MEA) whereby oleate ions are formed as further discussed below.

Additional components such as cosolvents for microemulsions, and other additives, may also be present.

As will be discussed more thoroughly below in connection with the process for forming the emulsion, surfactant components which are both lipophilic and hydrophilic are preferably selected and mixed for use in forming the emulsion, and this advantageously results in the formation of an interface in the emulsion between the water phase and the hydrocarbon phase which includes a mixture of both surfactant components.

Microemulsions according to the invention are advantageously provided with a ratio by volume of water to surfactant which is greater than about 1. Macroemulsions according to the invention are advantageously formed with very small amounts of surfactant, preferably less than or equal to about 4% vol., and having a ratio by volume of water to surfactant of greater than about 2.5.

The emulsions of the present invention preferably include water by volume with respect to the emulsion in an amount of at least about 5%, preferably between about 5% vol. and about 15% vol. with respect to total volume of the emulsions. As will be illustrated in the data to follow, the particular surfactant package and the mixing intensity or energy dissipation rate of the present invention both appear critical in providing acceptably stable emulsions.

It should also be noted that the emulsion of the present invention as compared to a base fuel from which the emulsion was prepared compares favorably in connection with engine cylinder pressure versus crank angle, $NO_x$ exhaust gas emission, carbon exhaust gas emission, exhaust gas peak opacity and the like.

As set forth above, it is also within the scope of the present invention to modify the surfactant package so as to include additional functional groups which can be selected so as to provide desirable properties in the resulting emulsion fuel.

For example, a nitro-olefin derivate of oleic acid can be obtained, for example by using nitrogen monoxide to modify the oleic acid. Such a nitro-olefin derivate of oleic acid can be utilized during emulsion formation and remains active in the final emulsion as a cetane number improver for providing the emulsion with a higher cetane number as compared to a microemulsion formed with a normal oleic acid as a component of the surfactant package. Of course, other functional groups, particularly other nitrogen functional groups, could advantageously be incorporated into the surfactant package for various other desirable results. Other functional groups that can advantageously be incorporated into the surfactant package include ketones, hydroxy and epoxy groups, and the like.

Emulsions in accordance with the present invention may suitably be formed as described below.

Suitable supplies of both water phase and hydrocarbon phase are obtained.

Once it is determined what type of emulsion is desired, that is, a microemulsion or a macroemulsion, a suitable surfactant package is selected.

Referring to FIG. 1, the steps of the method of the present invention are illustrated in terms of the type of droplet size formed and status of the surfactant. The process preferably starts the formation of a coarse dispersion which is refined and homogenized by turbulence-length scales of decreasing size (through mixing mechanisms associated with turbulent diffusion). The final stage of mixing involves microscale engulfment and stretching where the ultra low surface tension results in the formation of a microemulsion. Where no ultra-low interfacial tension is achieved, the fineness of the dispersion, for a given surfactant package, depends upon the intensity of the turbulence.

In order to prepare a microemulsion, the surfactant package is preferably selected including a hydrophilic component and a lipophilic component which are balanced so as to provide a surfactant package HLB of between about 6 and about 10. This surfactant package will be acceptable when utilized in conjunction with the additional process steps of the present invention for providing a stable microemulsion.

In order to form a suitable microemulsion, the three components, that is, the water phase, hydrocarbon phase and surfactant package are preferably combined in the desired volumes and subjected to a mixing intensity (W/kg) which is selected in accordance with the present invention in order to provide the desired type of emulsion. In accordance with the invention, to form a microemulsion, it is desirable to utilize a surfactant package having an HLB between about 6 and about 10 and a mixing intensity of between about 1 W/kg and about 10,000 W/kg. On an in-line production scale, the mixing intensity is more preferably between about 100 and about 1000 W/kg. If production rates are not critical, average mixing intensities between about 1 W/kg and about 100 W/kg also provide a stable microemulsion. Mixing according to the invention advantageously results in a desirable stable microemulsion having an average droplet size of between about 100 Å and about 700 Å. Emulsions formed according to the invention are advantageously stable in that the emulsion will retain an average droplet diameter, when stored under normal ambient conditions, for at least about 1 year and typically for an indefinite period of time.

The mixing intensity referred to herein is presented as average mixing intensity, averaged over the mixing profile of a vessel. Depending upon the mixing intensity and mixing time used, different orders of mixing intensity can be encountered within the mixing vessel. For example, mixing can be accomplished in accordance with the present invention utilizing a Rushton impulsor coupled to a Heidolph motor for providing the desired mechanical energy dissipation rate or mixing intensity. In a typical vessel mixed with this equipment, while the vessel may be mixed having an average energy dissipation rate of about 1 W/kg, the mixing intensity in close proximity to the mixing apparatus can in actuality be closer to the order of 100 W/kg. Mixing under such conditions will be referred to herein as mixing at an average mixing intensity of about 1 W/kg, or in the alternative, as 1-100 W/kg.

With other equipment, such as a rotor-stator mixer, the mixing intensity can be made nearly uniform.

It should also be noted that the mixing intensity as referred to herein relates to the energy dissipation rate as measured in power dissipated per unit mass of liquid in the mixer. The flow is assumed to be turbulent.

The different phases used for forming the microemulsion are preferably mixed so as to provide a water content in the final emulsion of at least about 5%, preferably between about 5% vol. and about 15% vol. with respect to total volume of the final emulsion product. The surfactant package is preferably provided in amounts of less than or equal to about 14% vol. with respect to the emulsion, which is particularly advantageous as compared to the amounts of surfactant package required to provide a stable microemulsion using conventional techniques. It is particularly advantageous that the method of the present invention allows for preparation of an emulsion having a ratio by volume of water to surfactant package which is greater than or equal to about 1.

In order to form a suitably stable microemulsion, it may also be necessary to utilize a small volume of cosolvent. However, it should be noted that the amount of cosolvent necessary is substantially reduced as compared to conventional processes as well. Typically, a suitably stable microemulsion can be formed utilizing less than or equal to about 2% vol. of cosolvent. Suitable cosolvents are alcohols, preferably an alcohol selected from the group consisting of methanol, ethanol, iso-propanol, n-butanol, ter-butanol, n-pentanol, n-hexanol and mixtures thereof.

In accordance with the present invention, it is preferred to mix the surfactant package and the cosolvent with the hydrocarbon phase, and then to mix the water and hydrocarbon phases together. Of course, other mixing procedures are also suitable within the scope of the present invention.

Suitable mixing equipment is readily available to the person of ordinary skill in the art. Examples of suitable mixing equipment are set forth above and in the examples to follow.

It should also be noted that various additional additives can be incorporated into the emulsion depending upon desired characteristics and intended use of the final emulsion product.

As set forth above, the surfactant package can advantageously be modified so as to include performance improving functional groups such as nitro-groups and the like which advantageously serve to improve the cetane number of the final emulsion product.

Macroemulsions are formed in accordance with the present invention as follows. As with microemulsion preparation supplies of suitable water and hydrocarbon phases are obtained.

A surfactant package is then preferably selected having an HLB of between about 3 and about 10. As with the microemulsions, this HLB is obtained by blending lipophilic and hydrophilic surfactant components as described above, in proportions sufficient to provide the desired HLB. The water, hydrocarbon and surfactant package components are then mixed at a mixing intensity selected so as to provide the desired macroemulsion, preferably having an average droplet size of between about 0.5 and about 2.0 microns. It is preferred that the macroemulsion be mixed at a mixing intensity of greater than or equal to about 10,000 W/kg, and this mixing intensity corresponds to an energy dissipation rate during turbulent flow as with the microemulsion formation process. The acceptable mixing intensity can be imparted to the mixture of ingredients using known equipment which would be readily available to the person of ordinary skill in the art.

Macroemulsions can advantageously be formed in accordance with the method of the present invention without the need for cosolvents which are typically required to form macroemulsions according to conventional procedures. Thus, the surfactant stabilizing portion of the emulsion and surfactant package preferably consists essentially of the lipophilic surfactant component and the hydrophilic surfactant component, and the emulsion can be prepared substantially free of any cosolvents whatsoever. This is particularly advantageous in reducing the cost of the final product.

As will be set forth in the samples to follow, water in hydrocarbon emulsions prepared in accordance with the present invention clearly compare favorably to the base hydrocarbon when used as a fuel and show consistent reduction in $NO_x$ and other favorable properties as compared to the base fuel.

The following examples demonstrate advantageous characteristics of the emulsions of the present invention.

EXAMPLE 1

This example illustrates the formation of microemulsions in accordance with the present invention and demonstrates the criticality of mixing intensity or energy dissipation rate in providing a stable microemulsion using reduced amounts of surfactants. Values provided in this example will be average mixing intensities based on total mass of mixture. It should of course be noted that mixing intensities much larger than average can be encountered in the mixing vessel, for example near the mixing apparatus.

Microemulsions were prepared utilizing 5% volume of water (310 ppm brine), a hydrocarbon phase of Diesel fuel as described above in Table 1 and surfactant packages including one or more components of lipophilic neat oleic acid (HLB=1.3), lipophilic sorbitan ester monooleate (HLB=4.3) and lipophilic ethoxylated oleic acid (5 EO, HLB=7.7), and hydrophilic oleic acid 100% neutralized with monoethanolamine.

The first samples of emulsion prepared under this example were prepared using a surfactant package including a lipophilic surfactant component of oleic acid having an HLB of 1.3 and a hydrophilic oleic acid 100% neutralized with monoethanolamine (oleate ions, HLB=18). These components were provided in a 1:1 ratio by volume and utilized to form emulsions as set forth in Table 2 below:

Sample 1 was prepared using 8% volume of surfactant package and a mixing intensity generated through manual agitation of about 0.1 W/kg or less for approximately 2-5 minutes (spontaneous formation). Sample 2 was prepared utilizing 4% volume of surfactant package and moderate turbulence utilizing a Rushton impulsor coupled to a Heidolph motor for providing an average mechanical energy dissipation rate of 1 W/kg for a period of approximately 5 minutes. Sample 3 was prepared also utilizing 4% volume of the surfactant package, but with manual agitation of less than 0.1 W/kg as with Sample 1.

As shown in Table 2, Sample 1 resulted in a microemulsion, but required 8% volume of surfactant. Sample 3 utilizing 4% volume of the surfactant package and manual agitation resulted in an unstable macroemulsion.

Sample 2, prepared in accordance with the present invention, provided a stable microemulsion utilizing only 4% volume of surfactant package which is, of course, advantageous as compared to the 8% volume required for Sample 1.

Samples 4-5 were then prepared utilizing the same surfactant package and 10% volume of water. Sample 4 was prepared utilizing 14% volume of surfactant package and manual agitation. Sample 5 was prepared using 7% volume of surfactant package and a vessel averaged mixing intensity of 1 W/kg. Sample 6 was prepared utilizing 7% volume of surfactant package and manual agitation.

Table 3 sets forth the results obtained for these samples.

TABLE 2

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mixing Intensity W/kg | Obs. |
|---|---|---|---|---|---|---|---|---|---|
| 1 | Neat Oleic Acid/Oleic Acid 100% neutralized with mono-ethanolamine | 84.6 | 8 (4/4) | 0.86 | 5 | 1.5 | 9.5 | Manual agitation | Micro-emulsion |
| 2 | Neat Oleic Acid/Oleic Acid 100% neutralized with mono-ethanolamine | 89.1 | 4 (2/2) | 0.43 | 5 | 1.5 | 9.5 | 1 | Micro-emulsion |
| 3 | Neat Oleic Acid/Oleic Acid 100% neutralized with mono-ethanolamine | 89.1 | 4 (2/2) | 0.43 | 5 | 1.5 | 9.5 | Manual agitation | Unstable Macro-emulsion |

TABLE 3

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mixing Intensity W/Kg | Obs. |
|---|---|---|---|---|---|---|---|---|---|
| 4 | Neat Oleic Acid/Oleic Acid 100% neutralized with mono-ethanolamine | 73.6 | 14 (7.6/6.4) | 1.40 | 10 | 1.0 | 8.9 | Manual agitation | Micro-emulsion |
| 5 | Neat Oleic Acid/Oleic Acid 100% neutralized with mono-ethanolamine | 81.3 | 7 (3.8/3.2) | 0.70 | 10 | 1.0 | 8.9 | 1 | Micro-emulsion |
| 6 | Neat Oleic Acid/Oleic Acid 100% neutralized with mono-ethanolamine | 81.3 | 4 (3.8/3.2 | 0.70 | 10 | 1.0 | 8.9 | Manual agitation | Unstable Macro-emulsion |

As shown, Sample 4 resulted in a microemulsion, but required 14% volume of surfactant, which is greater than the water content of this emulsion. Sample 6 utilizing a lower content of surfactant resulted in an unstable macroemulsion.

Sample 5 prepared in accordance with the present invention resulted in a stable microemulsion while advantageously utilizing a substantially reduced amount of surfactant package as compared to Sample 4.

It should be noted that an additional sample was prepared utilizing the same amounts of components as listed for Sample 5, but with mixing intensity increased to 10,000 W/kg, and a stable microemulsion resulted. Here, a rotor-stator mixer was used and so the intensities of mixing can be made nearly uniform resulting in a single intensity value.

Samples 7-9 were prepared utilizing the same surfactant package discussed above with water content of 15% volume. Sample 7 was prepared using 20% volume of the surfactant package and manual agitation, Sample 8 was prepared in a conventional stirrer (Rushton disc turbine) utilizing 14% volume of surfactant package and moderate vessel-averaged mixing intensity of 1 W/kg, and Sample 9 was prepared utilizing 14% volume surfactant package and manual agitation. The results are set forth in Table 4.

TABLE 4

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mixing Intensity W/Kg | Obs. |
|---|---|---|---|---|---|---|---|---|---|
| 7 | Neat Oleic Acid/Oleic Acid 100% neutralized with mono-ethanolamine | 61.3 | 20 (10/10) | 2.15 | 15 | 1.5 | 9.5 | Manual agitation | Micro-emulsion |
| 8 | Neat Oleic Acid/Oleic Acid 100% neutralized with mono-ethanolamine | 68 | 14 (7/7) | 1.51 | 15 | 1.5 | 9.5 | 1 | Micro-emulsion |
| 9 | Neat Oleic Acid/Oleic Acid 100% neutralized with mono-ethanolamine | 68 | 14 (7/7) | 1.51 | 15 | 1.5 | 9.5 | Manual agitation | Unstable Macro-emulsion |

As shown, Sample 7 resulted in a stable microemulsion, but required more surfactant than water was present. Sample 9 utilized less surfactant package, but resulted in an unstable macroemulsion.

Sample 8, prepared in accordance with the present invention, provided a stable microemulsion having a ratio of water to surfactant of greater than 1.

Samples 10-12 were prepared utilizing a surfactant package including lipophilic sorbitan ester monooleate having an HLB of 4.3 and neat oleic having HLB equal to 1.3, and hydrophilic oleic acid which has been 100% neutralized with monoethanolamine (oleate ions, HLB=18). Samples 10 and 12 were prepared utilizing manual agitation for 2-5 minutes (≦0.1 W/kg). Sample 11 was prepared utilizing moderate turbulence, for approximately 1.5 minutes, while mixing with a Rushton impulser coupled to a Heidolph motor which provided a vessel averaged mechanical energy of 1 W/kg.

The results are shown in Table 5 for 10% volume water emulsions.

TABLE 5

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 10 | Sorbitan ester monooleate/ Neat Oleic Acid/Oleic Acid, 100% neutralized with Mono-ethanolamine | 73 | 13 (5.1/3/4.9) | 1.04 | 10 | 3.0 | 9.3 | Man agit. | Micro-emulsion |
| 11 | Sorbitan ester monooleate/ Neat Oleic Acid/Oleic Acid, 100% neutralized with Mono-ethanolamine | 81.6 | 5 (2/1.1/1.9) | 0.4 | 10 | 3.0 | 9.3 | 1 | Micro-emulsion |
| 12 | Sorbitan ester monooleate/ Neat Oleic Acid/Oleic Acid, 100% neutralized with Mono-ethanolamine | 81.6 | 5 (2/1.1/1.9) | 0.4 | 10 | 3.0 | 9.3 | Man. agit. | Unstable Macro-emulsion |

Sample 10 included 13% volume of the surfactant package and was made using manual agitation, and resulted in a microemulsion. However, this emulsion has a ratio of water to surfactant package of less than 1. Sample 12 was prepared using 5% volume of the surfactant package and manual agitation, but resulted in an unstable macroemulsion. Sample 11 prepared in accordance with the present invention utilized 5% volume of the surfactant package and moderate turbulence and resulted in a stable microemulsion as desired.

Samples 13-15 were then prepared utilizing a surfactant system including lipophilic ethoxylated oleic acid (5 EO, HLB=7.7), and oleic acid 100% neutralized with monoethanolamine (oleate ions, HLB=18).

Samples 13-15 were prepared using 10% volume of water. Sample 13 was prepared utilizing 15% volume of surfactant package and manual agitation. Sample 15 was prepared utilizing 10% volume surfactant package and manual agitation and Sample 14 was prepared with a Rushton disc turbine utilizing 10% of the surfactant package and moderate vessel-average turbulence intensity of 1 W/kg. Table 6 sets forth the results.

TABLE 6

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix Inten. W/Kg | Obs. |
|---|---|---|---|---|---|---|---|---|---|
| 13 | Ethoxylated Oleic Acid (5 EO)/Oleic Acid, 100% neutralized with Mono-ethanolamine | 66.4 | 15 (12/3) | 0.65 | 10 | 8.0 | 9.8 | Man. agit. | Micro-emulsion |
| 14 | Ethoxylated Oleic Acid (5 EO)/Oleic Acid, 100% neutralized with Mono-ethanolamine | 75.6 | 10 (8/2) | 0.43 | 10 | 4.0 | 9.8 | 1 | Micro-emulsion |
| 15 | Ethoxylated Oleic Acid (5 EO)/Oleic Acid, 100% neutralized with Mono-ethanolamine | 75.6 | 10 (8/2) | 0.43 | 10 | 4.0 | 9.8 | Man. agit. | Unstable Macro-emulsion |

Sample 13 resulted in a stable microemulsion, but required 15% volume surfactant which is greater than the water content of the emulsion. Sample 15 utilized less surfactant, but resulted in an unstable macroemulsion at the manual agitation. Sample 14 prepared in accordance with the present invention resulted in a stable microemulsion advantageously having a ratio by volume of water to surfactant 1.

It is clear from the results illustrated in Table 2-6 that the mixing intensity of the present invention is critical in allowing reduction of the surfactant package concentration used while forming a stable microemulsion, and that the method of the present invention readily provides stable microemulsions having water to surfactant ratio by volume of greater than 1 or equal to.

EXAMPLE 2

This example demonstrates the criticality of the desired HLB of the surfactant package in accordance with the present invention.

In this example, emulsions are formed using Diesel fuel as in Example 1 and using water phase of water (310 ppm brine) in the amount of 10% volume with respect to the emulsion. Each emulsion has been formed utilizing equipment as described in Example 1 to provide average mixing intensity or energy dissipation rate per unit mass of about 1 W/kg, with local intensities of about 100 W/kg.

The surfactant package in this example will include one or more surfactant components of lipophilic neat oleic acid, sorbitan ester monooleate, and sorbitan ester trioleate, and hydrophilic oleic acid neutralized with monoethanolamine and polyethoxylated fatty amine (5 NOE).

Table 7 sets forth results obtained for Samples 1-6—prepared using different surfactant packages as listed in the table.

TABLE 7

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 1 | Neat Oleic Acid | 82.0 | 7 | 0 | 10 | 1.0 | 1.03 | 1 | Two distinct liquid phases |
| 2 | Oleic Acid, 100% neutralized with Mono-ethanolamine | 80.5 | 7 | 1.52 | 10 | 1.0 | 18.0 | 1 | Oil in water Macro-emulsion |
| 3 | Neat Oleic Acid 100% neutralized with Mono-ethanolamine (oleate ions) | 81.3 | 7 (3.8/3.2) | 0.7 | 10 | 1.0 | 8.9 | 1 | Micro-emulsion |

As shown, Sample 1 was prepared utilizing only neat oleic acid having an HLB of 1.03, and two distinct liquid phases were obtained. Sample 2 was prepared utilizing only oleic acid 100% neutralized with monoethanolamine, such that the surfactant package has an HLB of 18.0, and an undesirable oil-in-water macroemulsion resulted. Sample 3, prepared utilizing a surfactant package including 3.8% volume neat oleic acid and 3.2% volume oleic acid 100% neutralized with monoethanolamine resulted in a surfactant package having an HLB of 8.9 and provided a desirable stable microemulsion.

Table 8 sets forth compositions utilized to prepare Samples 4-6 and results obtained.

TABLE 8

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 4 | Sorbitan ester monooleate | 81.7 | 8.3 | 0 | 10 | 0.0 | 4.3 | 1 | Unstable water in Oil Macro- |
| 5 | Polyethoxy-lated fatty amine | 81.7 | 8.3 | 0 | 10 | 0.0 | 10.0 | 1 | Ustable water in Oil Macro-emulsion |
| 6 | Sorbitan ester monooleate/ polyethoxy-lated fatty amine | 81.7 | 8.37 (6/2.3) | 0 | 10 | 0.0 | 8.3 | 1 | Micro-emulsion |

Sample 4 was prepared utilizing only sorbitan ester monooleate as surfactant package, resulting in an HLB of 4.3 and an unstable water-oil-macroemulsion. Sample 5 was prepared using only polyethoxylated fatty amine (HLB of 10), and produced an unstable oil-in-water macroemulsion. Sample 6 was prepared utilizing 6% volume of sorbitan ester monooleate and 2.3% volume of polyethoxylated fatty amine for a resulting surfactant package HLB of 8.4. This sample produced a desirable stable microemulsion.

Table 9 sets forth results obtained for Samples 7-9.

TABLE 9

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 7 | Oleic Acid, 100% neutralized with Mono-ethanolamine | 80.2 | 6 | 1.3 | 10 | 2.5 | 18.0 | 1 | Oil in water Macro-emulsion |
| 8 | Sorbitan ester trioleate | 81.5 | 6 | 0.0 | 10 | 2.5 | 1.8 | 1 | Water in Oil Macro-emulsion |
| 9 | Oleic Acid, 100% neutralized with Mono-ethanolamine/ Sorbitan ester trioleate | 81.07 | 6 (2/4) | 0.43 | 10 | 2.5 | 7.2 | 1 | Micro-emulsion |

Sample 7 was prepared utilizing a surfactant package of only oleic acid 100% neutralized with monoethanolamine and having an HLB of 18.0. This resulted in an undesirable oil-in-water macroemulsion. Sample 8 was prepared utilizing only sorbitan ester trioleate as the surfactant package, resulting in an HLB of 1.8 and an undesirable water-in-oil macroemulsion. Sample 9 was prepared utilizing 2% volume of oleic acid 100% neutralized with monoethanolamine and 4% volume sorbitan ester trioleate resulting in a surfactant package HLB of 7.2 and a desirable stable microemulsion.

Table 10 shows an emulsion prepared using a paraffin hydrocarbon (hexadecane) and the surfactant package in accordance with the present invention.

TABLE 10

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 1 | Neat Oleic Acid/Oleic Acid 100% neutralized with mono-ethanolamine oleate ions) | 79.7 | 9.4 (7.1/1.9) | 0.41 | 10 | 0.5 | 4.5 | 1 | Micro-emulsion |

As shown, through utilizing a surfactant package including 7.1% volume neat oleic acid and 1.9% volume oleic acid 100% neutralized with monoethanolamine, and mixing at an average intensity of 1 W/kg, a stable microemulsion is obtained. As shown, for this microemulsion, the surfactant package is prepared so as to provide an HLB of 4.5. This is in accordance with the findings of the present invention, wherein it has been found that lower HLB values, preferably between about 2 and about 5, are required in order to form a successful stable microemulsion for paraffin hydrocarbons.

EXAMPLE 3

This example illustrates the advantageously reduced amounts of solvent or cosolvent required in order to form stable microemulsions in accordance with the present invention.

Microemulsions having 10% volume of water and Diesel fuel as dehydrocarbon phase were prepared using various mixing intensities.

Table 11 set forth below illustrates results obtained for Samples 1-3.

TABLE 11

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 1 | Neat Oleic Acid/Oleic Acid 100% neutralized with Mono-ethanolamine (oleate ions) | 81.3 | 7 (3.8/3/2) | 0.7 | 10 | 1.0 | 8.9 | Man. agit. | Unstable Macro-emulsion |
| 2 | Neat Oleic Acid/Oleic Acid 100% neutralized with Mono-ethanolamine (oleate ions) | 77.3 | 7 (3.8/3/2) | 0.7 | 10 | 5.0 | 8.9 | Man. agit. | Micro-emulsion |

TABLE 11-continued

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 3 | Neat Oleic Acid/Oleic Acid 100% neutralized with Mono-ethanolamine (oleate ions) | 81.3 | 7 (3.8/3.2) | 0.7 | 10 | 1.0 | 8.9 | 1 | Micro-emulsion |

As shown in Table 11, each sample was prepared using a surfactant package having 3.8% volume neat oleic acid and 3.2% volume oleic acid 100% neutralized with monoethanolamine. Sample 1 was prepared using 1% volume of n-Hexanol cosolvent, and manual agitation of less than or equal to about 0.1 W/kg, and an unstable macroemulsion resulted.

Sample 2 was prepared using the same volume of surfactant package and 5% volume of n-Hexanol cosolvent, and manual agitation was sufficient to provide a microemulsion. Sample 3, prepared in accordance with the present invention using a conventional stirrer (Rushton disc turbine), also utilized the same volume percentage of surfactant package, and 1% volume of n-Hexanol cosolvent, with a vessel averaged mixing intensity of 1 W/kg, and a stable microemulsion resulted.

Table 12 shows results obtained for Samples 4, 5 and 6 prepared using n-butanol cosolvent.

Sample 4 was prepared with 0.8% volume n-butanol and manual agitation, and an unstable macroemulsion resulted.

Sample 5 was prepared using 7.0% volume n-butanol and manual agitation, and a satisfactory microemulsion resulted.

Sample 6 was prepared in accordance with the present invention (standard Rushton disc turbine) and contained 0.8% volume n-butanol and was mixed at a vessel-averaged mixing intensity of 1 W/kg, and a desirable stable microemulsion resulted. Thus, preparation of the emulsion in accordance with the present invention allows formation of a stable microemulsion with significantly reduced concentrations of cosolvent.

Similar results were also obtained in accordance with the present invention utilizing less than or equal to about 1% volume of n-butanol, isopropanol, ethanol and methanol cosolvents, and this is set forth in Table 13.

TABLE 12

| Sample No. | Surfactant | Vol. % Diesel | Vol. % Surfactant | Vol. % Mono-ethanol amine- | Vol. % Deionized Water (310 ppm Brine) | Vol. % n-Butanol | HLB | Mix. Intens. W/Kg | Obs. |
|---|---|---|---|---|---|---|---|---|---|
| 4 | Neat Oleic Acid/Oleic Acid 100% neutralized with Mono-ethanolamine | 79.4 | 9 | 0.8 | 10 | 0.8 | 8.0 | Man. agit. | Unstable Macro-emulsion |
| 5 | Neat Oleic Acid/Oleic Acid 100% neutralized with Mono-ethanolamine (oleate ions) | 73.2 | 9 | 0.8 | 10 | 7.0 | 8.0 | Man. agit. | Micro-emulsion |
| 6 | Neat Oleic Acid/Oleic Acid 100% neutralized with Mono-ethanolamine (oleate ions) | 79.4 | 9 | 0.8 | 10 | 0.8 | 8.0 | 1 | Micro-emulsion |

TABLE 13

| Cosolvent (% (v/v) | Diesel % (v/v) | Oleic Acid % (v/v) | Mono-ethanol-amine % (v/v) | $H_20$ % (v/v) | HLB |
|---|---|---|---|---|---|
| Methanol (0.2) | 80.1 | 9 | 0.7 | 10 | 7.3 |
| Ethanol (0.77) | 79.4 | 9 | 0.8 | 10 | 8 |
| Isopropanol (0.69) | 79.6 | 9 | 0.7 | 10 | 7 |
| n-Propanol (0.8) | 79.4 | 9 | 0.8 | 10 | 8 |

Table 13 lists four separate stable microemulsions that were formed and the amount of cosolvent, hydrocarbon phase, surfactant, water and HLB for each emulsion. In each case, a stable microemulsion is provided in each case using less than 1% volume of cosolvent and a vessel-averaged mixing intensity of 1 W/kg.

EXAMPLE 4

This example illustrates preparation of macroemulsions in accordance with the present invention. These macroemulsions are in all cases water in Diesel (W/O) two phase systems, and are opaque to visible light (milky appearance). Macroemulsions are defined as emulsions having an average droplet size of between about 0.5 and about 2 microns.

The surfactant package used in preparing each of these emulsions included one or more surfactant components including lipophilic neat oleic acid, lipophilic sorbitan ester monooleate and hydrophilic oleic acid 100% neutralized with monoethanolamine.

Table 14 shows results obtained for samples 1 and 2 as set forth below.

TABLE 14

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 1 | Neat Oleic Acid/Oleic Acid 100% neutralized with Mono-ethanolamine | 93.0 | 1 (0.89/0.11) | 0.026 | 5 | 0.0 | 3.0 | 1 | Unstable Macro-emulsion |
| 2 | Neat Oleic Acid/Oleic Acid 100% neutralized with Mono-ethanolamine | 93.0 | 1 (0.89/0.11) | 0.026 | 5 | 0.0 | 3.0 | ≧10000 | Stable Macro-emulsion |

Samples 1 and 2 were each prepared using 1% volume of surfactant package, each having an HLB of 3.0. These samples were prepared having 5% volume of water (310 ppm brine), and each was prepared without the use of a cosolvent. Sample 1 was prepared using moderate turbulence, mixing with a Rushton impulser coupled to a Heidolph motor, which provided an average mechanical power or energy dissipation rate of 1 W/kg, for 2 minutes (maximum local value of 100 W/kg). The result was an unstable macroemulsion. Sample 2 was prepared utilizing high turbulence, mixing with an Ultraturrax mixer (rotor-stator mixer), which provided mechanical power or energy dissipation rate of 10,000 W/kg for 2 minutes. This resulted in a stable macroemulsion. Thus, the mixing intensity of the present invention is critical in obtaining a stable macroemulsion.

Table 15 shows results obtained with Samples 3, 4, 5 and 6, and further illustrates the criticality of mixing intensity in accordance with the present invention.

TABLE 15

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 3 | Neat Oleic Acid/Oleic Acid 100% | 87.9 | 2.0 (1.77/0.23) | 0.05 | 10 | 0.0 | 3.0 | 1 | Unstable Macro-emulsion |

TABLE 15-continued

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| | neutralized with Mono-ethanolamine | | | | | | | | |
| 4 | Neat Oleic Acid/Oleic Acid 100% neutralized with Mono-ethanolamine | 87.9 | 2.0 (1.77/0.23) | 0.05 | 10 | 0.0 | 8.0 | ≧10000 | Stable Macro-emulsion |
| 5 | Neat Oleic Acid/Oleic Acid 100% neutralized with Mono-ethanolamine | 87.8 | 2.0 (1.01/0.99) | 0.22 | 10 | 0.0 | 9.5 | 1 | Unstable Macro-emulsion |
| 6 | Neat Oleic Acid/Oleic Acid 100% neutralized with Mono-ethanolamine | 87.8 | 2.0 (1.01/0.99) | 0.22 | 10 | 0.0 | 9.5 | ≧10000 | Sable Macro-emulsion |

Samples 3 and 4 were prepared utilizing the same surfactant package having an HLB of 3.0, and a vessel-averaged mixing intensity of 1 W/kg provided an unstable macroemulsion while a mixing intensity of 10,000 W/kg produced a stable macroemulsion. Samples 5 and 6 were prepared utilizing a different surfactant package having an HLB of 9.5, and similar results were obtained. Thus, the method of the present invention can provide a stable macroemulsion at HLB values of 3 and 9.5.

Table 16 sets forth results obtained utilizing a different surfactant package. This surfactant package included 1.2% volume sorbitan ester monooleate (HLB=4.3) and 0.05% volume oleic acid 100% neutralized with monoethanolamine and had a resulting HLB of 3.

TABLE 16

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mixing Intensity W/Kg | Obs. |
|---|---|---|---|---|---|---|---|---|---|
| 7 | Sorbitan ester monooleate/ Oleic Acid 100% neutralized with mono-ethanolamine | 93.7 | 1.25 (1.2/0.05) | 0.01 | 5 | 0.0 | 3 | 1 | Unstable Macro-emulsion |
| 8 | Sorbitan ester monooleate/ Oleic Acid 100% neutralized with mono-ethanolamine | 93.7 | 1.25 (1.2/0.05) | 0.01 | 5 | 0.0 | 3 | ≧10000 | Stable Macro-emulsion |

The emulsions prepared for Samples 7 and 8 were 5% water emulsions, and Sample 7 prepared utilizing a vessel-averaged mixing intensity of 1 W/kg resulted in an unstable macroemulsion. Sample 8 prepared in accordance with the present invention at a mixing intensity of 10,000 W/kg, however, resulted in a stable macroemulsion.

Table 17 sets forth results obtained utilizing two additional surfactant packages for 10% volume of water emulsions.

TABLE 17

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 9 | Sorbitan ester monooleate/ Oleic Acid 100% neutralized with mono-ethanolamine | 87.5 | 2.5 (2.4/0.1) | 0.02 | 10 | 0.0 | 3.0 | 1 | Unstable Macro-emulsion |
| 10 | Sorbitan ester monooleate/ Oleic Acid 100% neutralized with mono-ethanolamine | 87.5 | 2.5 (2.0/0.5) | 0.02 | 10 | 0.0 | 3.0 | ≧10000 | Stable Macro-emulsion |
| 11 | Sorbitan ester monooleate/ Oleic Acid 100% neutralized with mono-ethanolamine | 87.3 | 2.5 (1.6/0.9) | 0.2 | 10 | 0.0 | 9.5 | 1 | Unstable Macro-emulsion |
| 12 | Sorbitan ester monooleate/ Oleic Acid 100% neutralized with mono-ethanolamine | 87.3 | 2.5 ((1.6/0.9) | 0.2 | 10 | 0.0 | 9.5 | ≧10000 | Stable Macro-emulsion |

Samples 9 and 10 were both prepared utilizing surfactant packages including 2.4% volume sorbitan ester monooleate and 0.1% volume oleic acid 100% neutralized with monoethanolamine. This surfactant had an HLB of 3.0. Sample 9 was prepared utilizing a vessel-averaged mixing intensity of 1 W/kg, and an unstable macroemulsion resulted. Sample 10 was prepared utilizing mixing intensity in accordance with the present invention of 10,000 W/kg, and a stable macroemulsion resulted.

Samples 11 and 12 show similar results when the surfactant package is modified to have an HLB of 9.5.

Thus, as demonstrated above, Diesel fuel macroemulsions can be prepared in accordance with the present invention at greatly reduced surfactant concentrations and having HLB values of between 3 and 10. Further, solvents or cosolvents are not needed to form a stable macroemulsion.

EXAMPLE 5

Water incorporation is achieved in accordance with the present invention, in both microemulsions and macroemulsions, by adjusting the hydrophilic to lipophilic balance of the surfactant package and the mixing conditions. This versatility allows the development of the most cost effective fuel formations, depending on current market needs, based upon the synergistic effect between surfactant concentration and energy dissipation rate in the mixing process. This example demonstrates such different formulations which can be prepared.

10% volume water in Diesel fuel emulsions were prepared utilizing a surfactant package including neat oleic acid and oleic acid 100% neutralized with monoethanolamine. Table 18 sets forth results obtained for Samples 1 and 2.

TABLE 18

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 1 | Neat Oleic Acid/Oleic Acid 100% neutralized with mono-ethanolamine | 81.3 | 7 (3.8/3.2) | 0.70 | 10 | 1.0 | 8.9 | ≧10000 | Micro-emulsion |
| 2 | Neat Oleic Acid/Oleic Acid 100% neutralized with mono-ethanolamine | 87.8 | 2 (1.08/0.92) | 0.2 | 10 | 0.0 | 8.9 | ≧10000 | Stable Macro-emulsion |

As shown, Sample 1 was prepared using 7% volume of the surfactant package to provide an HLB of 8.9, with 10% volume of water and 1% volume of n-Hexanol cosolvent. The mixing intensity was high, that is 10,000 W/kg, and a stable microemulsion resulted. Sample 2 was prepared utilizing the same conditions, but 2% volume of the surfactant package and no cosolvent whatsoever. This resulted in a stable macroemulsion. Thus, through adjusting the amounts of surfactant and cosolvent, microemulsion and macroemulsion can selectively be prepared to meet particular market needs.

Table 19 sets forth a similar comparison utilizing a surfactant package of oleic acid 100% neutralized with monoethanolamine and sorbitan ester trioleate (HLB=1.8).

TABLE 19

| Sample No. | Surfactant | Vol. % Diesel | Vol. % Surfactant | Vol. % Mono-ethanol-amine | Vol. % Deionized Water (310 ppm Brine) | Vol. % n-Hexanol | HLB | Mix. Inten. W/Kg | Obs. |
|---|---|---|---|---|---|---|---|---|---|
| 3 | Oleic Acid 100% neutralized with mono-ethanolamine/ Sorbitan ester trioleate | 81.07 | 6 (2/4) | 0.43 | 10 | 2.5 | 7.2 | ≧10000 | Micro-emulsion |
| 4 | Oleic Acid 100% neutralized with mono-ethanolamine/ Sorbitan ester trioleate | 87.4 | 2 (0.62/1.9) | 0.14 | 10 | 0.0 | 7.2 | ≧10000 | Stable Macro-emulsion |

These samples were also prepared containing 10% volume of water, and the surfactant package had an HLB of 7.2. Further, both samples were prepared using a mixing intensity of 10,000 W/kg. Sample 3 included 6% volume of the surfactant package and 2.5% volume of n-Hexanol cosolvent, and a stable microemulsion resulted. Sample 4 was prepared utilizing 2.5% volume of the surfactant package and no cosolvent and a stable macroemulsion resulted. Thus, as with Table 18, desirable microemulsions and macroemulsions can be obtained to meet market needs by adjusting the amount of surfactant and cosolvent to be used.

EXAMPLE 6

This example demonstrates the chemical modification of a surfactant package in accordance with the present invention so as to provide an additional property to the final emulsion, in this case for enhancing auto ignition properties of the microemulsion.

A nitro-olefin derivate of oleic acid was prepared for use as a surfactant component as follows. A flask containing a solution of oleic acid (10 g; 0.035 moles) in 1,2-dichloroethane (200 ml) was evacuated. Then, the flask was filled with nitrogen monoxide gas and the solution was stirred under atmospheric pressure of nitrogen monoxide at room temperature for 3 hours. The nitrogen monoxide was released, and the solvent was removed in a vacuum so as to provide a nitro-olefin derivate of oleic acid (60%) which was identified by $^{1}H$ NMR, $^{13}C$ NMR and IR analysis.

A microemulsion of 10% volume water in Diesel fuel was prepared with sample 1 using a surfactant package including oleic acid 50% neutralized with monoethanolamine so as to provide an HLB of 3, and with Sample 2 prepared utilizing nitro olefin derivate of oleic acid 50% neutralized with monoethanolamine to provide an HLB of 3.0. Table 20 sets forth analysis results for both samples.

TABLE 20

| Sample No. | Surfactant | Vol. % Diesel | Vol. % Surfactant | Vol. % Mono-ethanol-amine | Vol. % Deionized Water (310 ppm Brine) | Vol. % n-Hexanol | Mix. Inten. W/Kg | Cetane Number |
|---|---|---|---|---|---|---|---|---|
| 1 | Oleic Acid 50% neutralized with mono-ethanolamine | 79 | 9 | 1 | 10 | 1 | 1 | 41.6 |
| 2 | Nitro olefin derivate of oleic acid 50% neutralized with mono-ethanolamine | 79 | 9 | 1 | 10 | 1 | 1 | 45.2 |

As shown in Table 20, the microemulsions were prepared having 9% volume of the surfactant package and using 1% volume of n-Hexanol cosolvent, at a vessel-averaged mixing intensity of 1 W/kg. Each sample resulted in a stable microemulsion. Note, however, that Sample 1 had a cetane number of 41.6, while Sample 2 prepared utilizing the chemically modified surfactant package had an increased cetane number of 45.2. Thus, it is clear that in accordance with the present invention, the oleic acid surfactant component can be chemically modified, for example to incorporate a nitro-group, so as to improve the functionality of the surfactant package and the resulting microemulsion.

EXAMPLE 7

This example demonstrates excellent results of use of an emulsion as an engine fuel in accordance with the present invention, as compared to the base hydrocarbon used as fuel. As will be demonstrated below, the emulsion of the present invention shows consistent reduction of $NO_x$ at all operating regimes, reduction in particulate matter emissions, particularly at high partial loads, significant reduction in exhaust gas opacity under free acceleration conditions, reduced combustion duration by controlled rate of pressure rise and diffusion burning rates, adequate fuel stability in engine injection system components and improve fuel lubricity for protection of injection system components.

This example was conducted using a commercial Diesel engine installed on a test bench. The Diesel engine characteristics included 6 cylinders, direct injection, turbo charged, compression ratio: 17.5:1, displacement 5.78 liters, maximum torque; 328 Nw-m at 1800 rpm, maximum power: 153 Hp and 2500 rpm.

Steady state tests were conducted. Also, in-cylinder analysis was carried through combustion chamber and injection event observation based on piezoelectric pressure transducer measurements versus crank angle positions. Exhaust emission measurements were taken by transporting gaseous emissions to analyzer measurement cells through heated sample lines. $NO_x$ measurements were obtained using a chemiluminescence analyzer. The hydrocarbon measurement technique was a heated flame ionization detector. CO measurement was obtained utilizing a non-dispersive infrared analyzer. Transient tests were also conducted including integrated mass emission determination of carbonatious matter (C) using a modified US heavy duty transient cycle (1200 sec duration, rpm vs. low operation, motoring segments not applied, engine at idle). The measurement technique included analysis of the extinction of infrared radiation at specific wavelengths, with interference filters at 3.95 microns for carbon. Exhaust opacity during free acceleration test was measured using partial flow opacimeter (HSU).

Table 21 below sets forth the fuel properties for testing a base Diesel fuel and a microemulsion prepared utilizing this fuel in accordance with the present invention.

TABLE 21

| Characteristics | Base Fuel | Prototype |
|---|---|---|
| Oleic acid (% v) | — | 9.0 |
| Monoethanolamine (% v) | — | 1.0 |
| n-Hexanol (% v) | — | 1.0 |
| Water (% v) | — | 10.0 |
| Viscosity @ 40° C. (cSt) | 3.07 | 5.45 |
| Lubricity (microns) ASTM D-6079 HFRR @60° c. | 3.30 | 260 |
| Aromatic (% w) | 18.4 | 14.1 |
| Density @ 15.6° C. (mg/ml) | 0.839 | 0.863 |
| Cetane number | 47.3 | 46.9 (with the addition of cetane improver |

Figure 2:
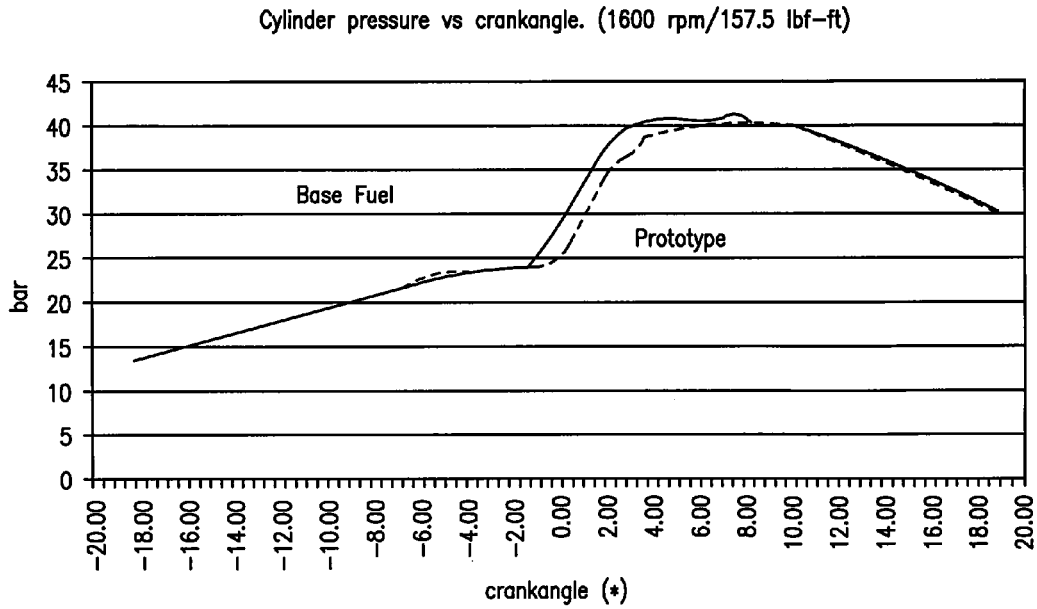
FIG. 2 is a comparative illustration of cylinder pressure versus crank angle of a base fuel as compared to a water-in-hydrocarbon fuel prepared in accordance with the present invention.

Based upon the cylinder pressure versus crank angle measurements for the operating condition of 1600 rpm and 157.5 pounds—ft of torque (50% of partial load), as indicated in FIG. 2, a heat release calculation was performed in the closed portion of the thermodynamic cycle to determine fuel combustion details. The results of this calculation are shown in Table 22.

TABLE 22

| Variable | Base fuel | Prototype |
|---|---|---|
| Start of injection (° before top dead center) | 9.0 | 8.0 |
| Ignition delay (°) | 4.8 | 6.4 |
| Crankangle for 90% of the injected fuel energy release | 38.0 | 35.2 |

It can be inferred that considering similar conditions of start of injection, longer ignition delay and faster combustion rate during diffusion burning (similar total energy release for smaller number of crank angles), strongly determines the performance for the microemulsion of the present invention as compared to the base fuel.

A qualitative explanation can be devised considering (a) different localized temperature regimes due to extended cold fuel jet and energy required for water vaporization and heating; (b) an enhanced fuel-air mixing mechanism; both of which are related to water being present in the injected Diesel fuel droplets. It is believed that the incorporation of the water phase promotes additional breakup and dispersion with relatively wider spray angles and higher air entrainment during the fuel atomization process. Oxygen contribution due to accessibility, soot formation inhibition and mixture leaning are also potential acting mechanisms.

Figure 3:
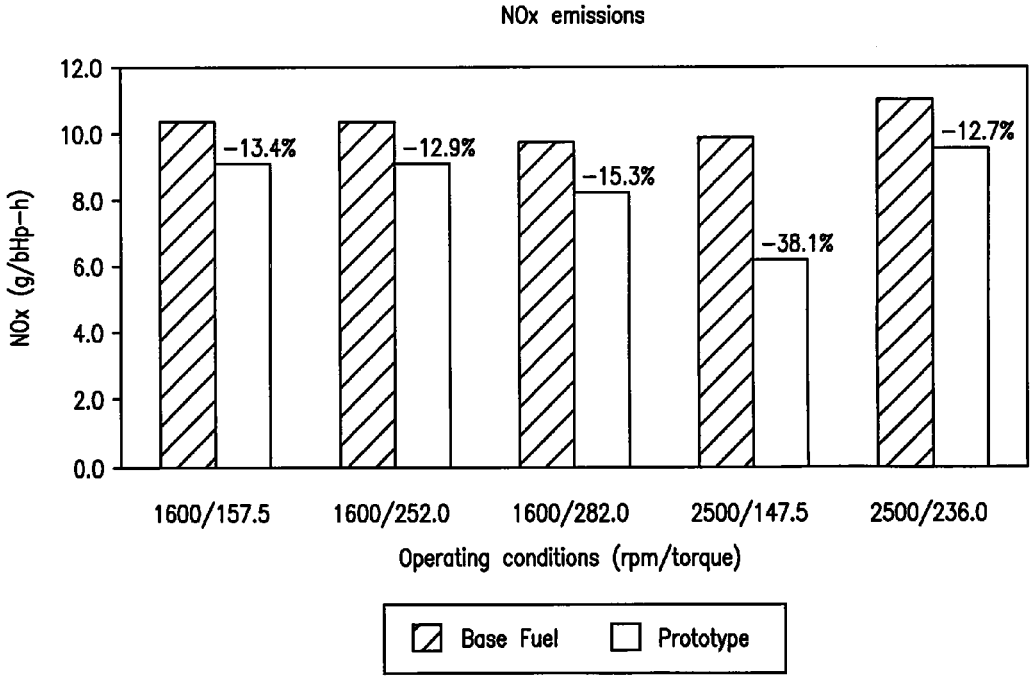
FIG. 3 is a comparative illustration of $NO_x$ exhaust gas emission rates at steady state conditions for a base fuel and an emulsion in accordance with the present invention.

Fuel stability at engine conditions was observed and is satisfactory based upon the absence of fuel/water separation in the return fuel line for excess and leak back flow from injectors. FIG. 3 shows $NO_x$ exhaust gas emission rates for both fuels, and the microemulsion of the present invention shows consistent reduction of $NO_x$ at all operating regimes.

Figure 4:
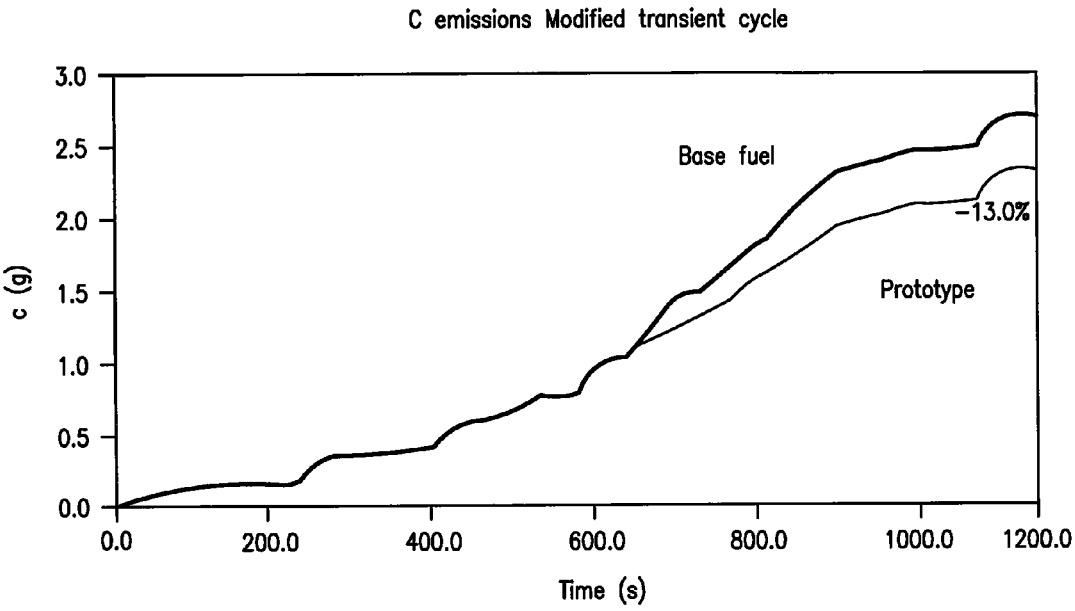
FIG. 4 is a comparative illustration of cumulative carbon exhaust gas emission during engine transient operation utilizing a base fuel and an emulsion in accordance with the present invention.

Particulate matter emissions were reduced at high loads as shown by consideration of accumulated exhaust gas carbon mass during transient engine operation. The carbon mass emissions between the microemulsion of the present invention and the base fuel began to differ significantly after applying high partial loads to the engine in transient operation. This is also illustrated in FIG. 4.

Figure 5:
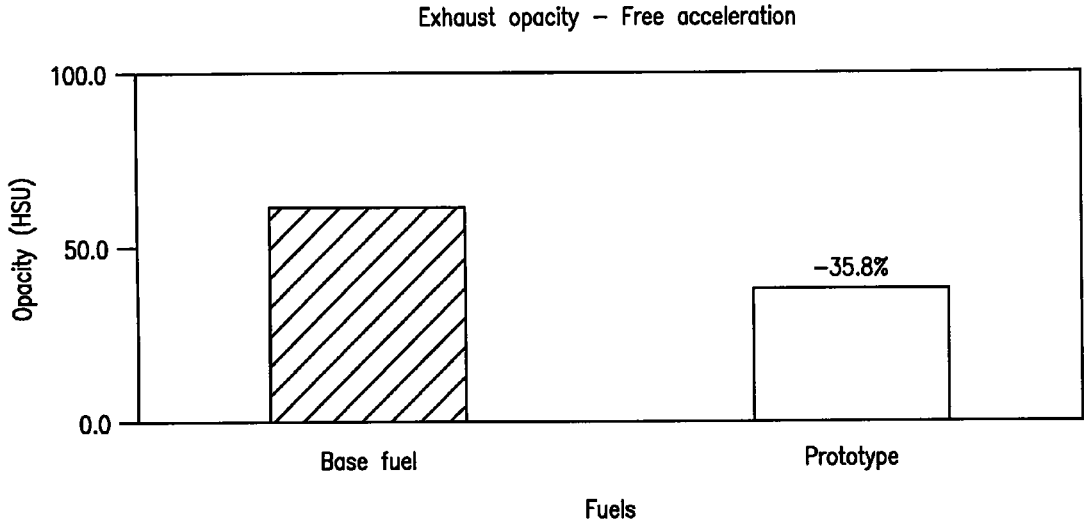
FIG. 5 is a comparative illustration of exhaust gas peak opacity during free acceleration for a base fuel and an emulsion in accordance with the present invention.

Significant reductions of exhaust gas opacity under free acceleration conditions are also illustrated in FIG. 5. This reduction in opacity also out-performed several other fuel reformulation possibilities which have been previously tested on this same engine, namely, lower aromatics, higher cetane, and lower sulfur fuel as compared to prototype fuel.

It was also possible to achieve reduced ignition delays among different water emulsified fuels, which will result in improved engine performance, by controlled rate of pressure rise due to varying the amount of surfactant package and modifying the real logical properties of the fuel in the spray plume.

Thus, the microemulsion of the present invention is clearly an advantageous alternative to the base fuel.

EXAMPLE 8

As set forth above, the present invention also provides for tuning of a fuel to specific combustion chamber environment conditions. This is accomplished by adjusting the chemistry of the fuel and its physico-chemical and rheologic properties. To illustrate this, a second microemulsion fuel formulation was prepared and compared to the microemulsion prepared in Example 7. Table 23 lists the characteristics of the Example 7 microemulsion and microemulsion 2, each of which incorporates 10% volume of water. Microemulsion 2 was prepared utilizing a lower concentration of the surfactant package and different mixing intensity conditions, specifically, continuous production using a static mixer in turbulent flow, with energy dissipation rate per unit mass of mixture in the mixer of not less than 100 W/kg. Both fuels were also compared to the base fuel as described in Table 21.

TABLE 23

| Characteristics | Prototype | Prototype 2 |
|---|---|---|
| Oleic acid (% v) | 9.0 | 7.0 |
| Monoethanolamine (% v) | 1.0 | 0.7 |
| n-Hexanol (% v) | 1.0 | 0.7 |
| Water (% v) | 10.0 | 10.0 |
| Viscosity @ 40° C. (cSt) | 5.45 | 3.95 |
| Aromatic (% v) | 14.1 | 14.6 |
| Density @ 15.6 C. (mg/ml) | 0.863 | 0.852 |
| Cetane number | 46.9 (with the addition of cetane improver) | 46.5 (with the addition of cetane improver) |

As shown microemulsion 2 has reduced viscosity, slightly increased aromatics content and slightly reduced base cetane number.

Table 24 below sets forth engine performance comparison on the same engine as described in Example 7 for both the microemulsion of Example 7 and microemulsion 2 prepared as outlined in Table 23.

TABLE 24

| Engine performance | Prototype | Prototype 2 |
|---|---|---|
| NO*x* emissions (% of difference versus Base Fuel) Engine operating condition: 1600 rpm @ 252.0 lbf-ft | −12.9 | −12.0 |
| Soot emissions (% of difference versus Base Fuel) Engine operating condition: 1600 rpm @ 252.0 lbf-ft | −20.8 | −35.1 |
| Fuel conversion efficiency (% of difference versus Base Fuel) Engine operating condition: 1600 rpm @ 252.0 lbf-ft | −0.3 | +3.5 |
| Maximum engine brake horsepower (% of difference versus Base Fuel) Engine operating condition: (WOT) @ 2500 rpm | −13.2 | −7.3 |

As shown, similar reductions in $NO_x$ emissions were accomplished with both emulsions. This is believed to be related to the equivalent water content in both fuels.

However, soot emissions are improved utilizing microemulsion 2. Fuel conversion efficiency of fuel of microemulsion 2 is also improved and the power difference as compared to the base fuel is reduced from negative 13.2% to negative 7.3%. These results clearly indicate an improved engine performance which is accomplished by adjusting the physical chemical and rheological properties of the fuel during water incorporation.

EXAMPLE 9

This example is presented so as to demonstrate a synergism between oleic acid surfactant and the salt of oleic acid which is generated with monoethanolamine according to the invention.

Figure 6:
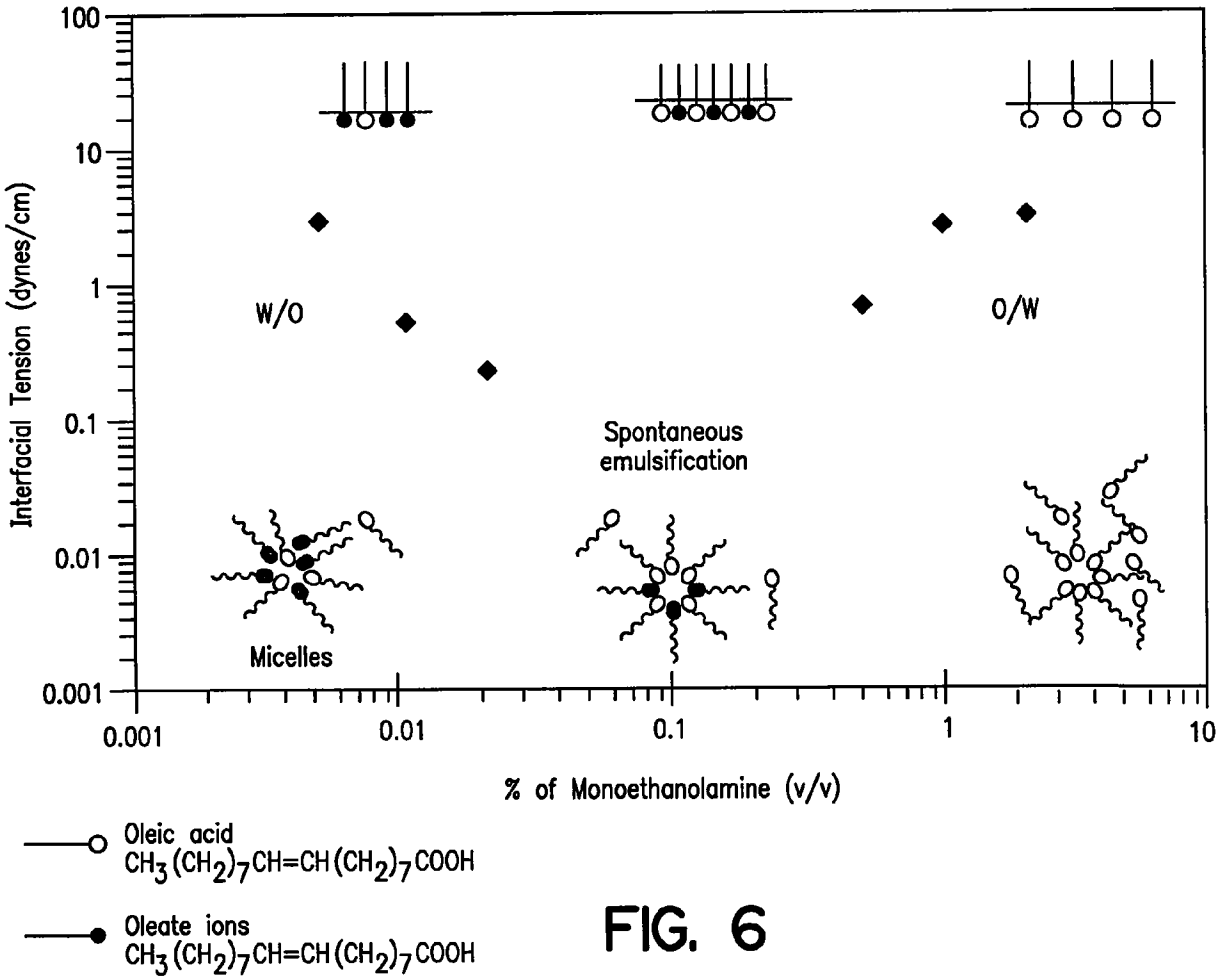
FIG. 6 is an illustration of interfacial tension versus concentration of monoethanolamine and the expected characteristics of the interface depending upon same.

FIG. 6 illustrates interfacial tension between water and hydrocarbon phases utilizing a surfactant package which includes 2% volume of oleic acid and varying amounts of monoethanolamine. As illustrated in this figure, there is a concentration interval of monoethanolamine (MEA) wherein ultra low interfacial tensions are obtained. When this point is reached, the system is emulsified spontaneously in the measurement equipment. In this concentration interval of MEA, there is found adsorbed in the interface Diesel/water the two surfactants, that is, oleic acid and oleate ions. In the extreme regions of FIG. 6, that is to say, at the low and high concentrations of MEA, are found the oleic acid and the oleate ions individually adsorbed in the interface, and the interfacial tensions are the highest. This is believed to be due to the following.

When the oleic acid dissolved in the Diesel fuel enters into contact with the MEA and the water, there occurs an acid/base reaction in the interface Diesel/water to give rise to the oleate ions. The oleic acid as well as the oleate ions are adsorbed in the interface Diesel/water due there infinity to the water as the oil. At intermediate concentrations of MEA (0.04-0.3% volume), the oleic acid is appreciably ionized so as to provide oleate ions, and the interface Diesel/water will be covered by both oleate ions and oleic acid. In this zone, synergistic interfacial tension is illustrated, since the interfacial tension is lower than that obtained from either of the surfactants individually.

It should be appreciated that a water-in-hydrocarbon emulsion has been provided which exhibits advantageous characteristics as compared to conventional fuels, and that methods for advantageously forming such emulsions have also been provided.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed:

1. A method for forming a stable water in liquid hydrocarbon microemulsion, comprising the steps of:

providing a liquid hydrocarbon phase;

providing a water phase;

providing a surfactant package having an HLB of between about 6 and about 10 and having a lipophilic component having an HLB of between about 1 and about 8 and a hydrophilic component having an HLB of between about 10 and about 18, wherein said surfactant package further includes a functional group for improving performance of said stable microemulsion as a combustible fuel, said functional group being different from said lipophilic component and said hydrophilic component and selected from the group consisting of nitrogen groups, ketones, hydroxy and epoxy groups, and mixtures thereof; and mixing said liquid hydrocarbon phase, said water phase and said surfactant package at a ratio by volume of said water phase to said surfactant of at least about 1, with said water phase in an amount of between about 5% and about 15% volume with respect to volume of said microemulsion, and at a mixing intensity of at least about 1 W/kg, so as to provide a stable water in liquid hydrocarbon microemulsion wherein said lipophilic component and said hydrophilic component are present at an interface between said water phase and said liquid hydrocarbon phase, and wherein said lipophilic component comprises a nitro-olefin derivate of oleic acid obtained by using nitrogen monoxide to modify the oleic acid.

2. The method of claim 1, wherein said functional group is a nitrogen oxide group.

3. A method for forming a stable water and liquid hydrocarbon macroemulsion, comprising the steps of:

providing a liquid hydrocarbon phase;

providing a water phase;

providing a surfactant package having an HLB of between about 3 and about 10 and having a lipophilic component having an HLB of between about 1 and 8 and a hydrophilic component having an HLB of between about 10 and about 18, wherein said surfactant package further includes a functional group for improving performance of said stable macroemulsion as a combustible fuel, said functional group being different from said lipophilic component and said hydrophilic component and selected from the group consisting of nitrogen groups, ketones, hydroxy and epoxy groups, and mixtures thereof; and mixing said liquid hydrocarbon phase, said water phase and said surfactant package at a ratio by volume of said water phase to said surfactant of at least about 1, with said water phase in an amount of between about 5% and about 15% volume with respect to volume of said macroemulsion, and at a mixing intensity of at least about 10,000 W/kg, so as to provide a stable water in liquid hydrocarbon macroemulsion wherein said lipophilic component and said hydrophilic component are present at an interface between said water phase and said liquid hydrocarbon phase, and wherein said lipophilic component comprises a nitro olefin derivate of oleic acid obtained by using nitrogen monoxide to modify the oleic acid.

4. The method of claim 3, wherein said functional group is a nitrogen oxide group.

5. A stable water-in-liquid hydrocarbon microemulsion, comprising a water phase, a liquid hydrocarbon phase and a surfactant package having an HLB of between about 6 and about 10 and having a lipophilic component having an HLB of between about 1 and about 8 and a hydrophilic component having an HLB of between about 10 and about 18, wherein said surfactant package further includes a functional group for improving performance of said stable microemulsion as a combustible fuel, said functional group being different from said lipophilic component and said hydrophilic component and selected from the group consisting of nitrogen groups, ketones, hydroxy and epoxy groups, and mixtures thereof; wherein said water phase and said surfactant package are present at a ratio by volume of said water phase to said surfactant package of at least about 1, wherein said water phase is present in an amount between about 5% and about 15% volume with respect to said microemulsion, and wherein said lipophilic component and said hydrophilic component are present at an interface between said water phase and said liquid hydrocarbon phase, and wherein said lipophilic component comprises a nitroolefin derivate of oleic acid obtained by using nitrogen monoxide to modify the oleic acid.

6. The microemulsion of claim 5, wherein said functional group is a nitrogen oxide group.

7. A stable water-in-liquid hydrocarbon macroemulsion, comprising a water phase, a liquid hydrocarbon, and a surfactant package having an HLB of between about 3 and about 10 and having a liquid lipophilic component having an HLB of between about 1 and about 8 and a hydrophilic component having an HLB of between about 10 and about 18; and wherein said surfactant package further includes a functional group for improving performance of said stable macroemulsion as a combustible fuel, said functional group being different from said lipophilic component and said hydrophilic component and selected from the group consisting of nitrogen groups, ketones, hydroxy and epoxy groups, and mixtures thereof, wherein said water phase and said surfactant package are present at a ratio by volume of said water phase to said surfactant package of at least about 1, wherein said water phase is present in an amount between about 5% and about 15% volume with respect to said macroemulsion, and wherein said lipophilic component and said hydrophilic component are present at an interface between said water phase and said liquid hydrocarbon phase, and wherein said lipophilic component comprises a nitroolefin derivate of oleic acid obtained by using nitrogen monoxide to modify the oleic acid.

8. The macroemulsion of claim 7, wherein said functional group is a nitrogen oxide group.

9. A method for forming a stable water in liquid hydrocarbon microemulsion, comprising the steps of:

providing a liquid hydrocarbon phase;

providing a water phase;

providing a surfactant package having an HLB of between about 6 and about 10 and having a lipophilic component having an HLB of between about 1 and about 8, a hydrophilic component having an HLB of between about 10 and about 18 and a functional group for improving performance of said stable microemulsion as a combustible fuel, wherein said functional group is a nitrogen oxide group; and mixing said liquid hydrocarbon phase, said water phase and said surfactant package at a ratio by volume of said water phase to said surfactant of at least about 1, with said water phase in an amount of between about 5% and about 15% volume with respect to volume of said microemulsion, and at a mixing intensity of at least about 1 W/kg, so as to provide a stable water in liquid hydrocarbon microemulsion wherein said lipophilic component and said hydrophilic component are present at an interface between said water phase and said liquid hydrocarbon phase, wherein said lipophilic component comprises a nitroolefin derivate of oleic acid obtained by using nitrogen monoxide to modify the oleic acid.

10. A method for forming a stable water and liquid hydrocarbon macroemulsion, comprising the steps of:

providing a liquid hydrocarbon phase;

providing a water phase;

providing a surfactant package having an HLB of between about 3 and about 10 and having a lipophilic component having an HLB of between about 1 and 8 and a hydrophilic component having an HLB of between about 10 and about 18 and a functional group for improving performance of said stable microemulsion as a combustible fuel, wherein said functional group is a nitrogen oxide group; and mixing said liquid hydrocarbon phase, said water phase and said surfactant package at a ratio by volume of said water phase to said surfactant of at least about 1, with said water phase in an amount of between about 5% and about 15% volume with respect to volume of said macroemulsion, and at a mixing intensity of at least about 10,000 W/kg, so as to provide a stable water in liquid hydrocarbon macroemulsion wherein said lipophilic component and said hydrophilic component are present at an interface between said water phase and said liquid hydrocarbon phase, wherein said lipophilic component comprises a nitro olefin derivate of oleic acid obtained using nitrogen monoxide to modify the oleic acid.

11. A stable water-in-liquid hydrocarbon microemulsion, comprising a water phase, a liquid hydrocarbon phase and a surfactant package having an HLB of between about 6 and about 10 and having a lipophilic component having an HLB of between about 1 and about 8 and a hydrophilic component having an HLB of between about 10 and about 18 and a functional group for improving performance of said stable microemulsion as a combustible fuel, wherein said functional group is a nitrogen oxide group, wherein said water phase and said surfactant package are present at a ratio by volume of said water phase to said surfactant package of at least about 1, wherein said water phase is present in an amount between about 5% and about 15% volume with respect to said microemulsion, and wherein said lipophilic component and said hydrophilic component are present at an interface between said water phase and said liquid hydrocarbon phase, wherein said lipophilic component comprises a nitroolefin derivate of oleic acid obtained by using nitrogen monoxide to modify the oleic acid.

12. A stable water-in-liquid hydrocarbon macroemulsion, comprising a water phase, a liquid hydrocarbon, and a surfactant package having an HLB of between about 3 and about 10 and having a liquid lipophilic component having an HLB of between about 1 and about 8 and a hydrophilic component having an HLB of between about 10 and about 18 and a functional group for improving performance of said stable microemulsion as a combustible fuel, wherein said functional group is a nitrogen oxide group, wherein said water phase and said surfactant package are present at a ratio by volume of said water phase to said surfactant package of at least about 1, wherein said water phase is present in an amount between about 5% and about 15% volume with respect to said macroemulsion, and wherein said lipophilic component and said hydrophilic component are present at an interface between said water phase and said liquid hydrocarbon phase, wherein said lipophilic component comprises a nitroolefin derivate of oleic acid obtained by using nitrogen monoxide to modify the oleic acid.

* * * * *